United States Patent [19]

Hutchison

[11] 4,415,063

[45] Nov. 15, 1983

[54] STILT DEVICE

[76] Inventor: James Hutchison, 2780 Calle Bienvendo, Thousand Oaks, Calif. 91360

[21] Appl. No.: 402,024

[22] Filed: Jul. 26, 1982

[51] Int. Cl.[3] ..... A63B 25/00

[52] U.S. Cl. ..... 182/230; 3/4; 272/70.1

[58] Field of Search ..... 182/230, 141, 148, 204, 182/205; 272/70.1, 70.2; 3/4

[56] References Cited

U.S. PATENT DOCUMENTS

| | | | |
|---|---|---|---|
| 238,042 | 2/1881 | Herrington | 272/70.1 |
| 1,190,421 | 7/1916 | Kalcy | 272/70.1 |
| 2,292,074 | 8/1942 | Hawk | 36/7.5 |
| 2,837,335 | 6/1958 | Koenig | 272/70.1 |
| 2,861,730 | 11/1958 | Deahl | 182/141 |
| 3,058,120 | 10/1962 | Smith | 272/70.1 |
| 3,346,882 | 10/1967 | Wilhoyte | 3/4 |
| 3,365,195 | 1/1968 | Hansburg | 272/70.1 |
| 3,441,272 | 4/1969 | Mann | 272/70.1 |
| 3,595,339 | 7/1971 | Ballard | 182/230 |

*Primary Examiner*—Reinaldo P. Machado

[57] ABSTRACT

The leg stilt device of the invention permits the user to safely adjust the height of the stilt while thereon and is stable, holding the user in a level safe position. The device includes one or more pairs of hollow tubular telescoping vertical support members, a horizontal platform secured to the upper end of the uppermost-extending such member, a broad flat horizontal base connected to the lower end of the lowermost extending vertical member of each pair and providing the desired stability, a tubular leg brace connected to and extending above the platform, and a stilt height adjusting mechanism releasably coupling the two vertical members together. The adjusting mechanism includes a biasing spring, shoe strap or the like, for urging the platform vertically, a pin releasably disposable horizontally through aligned horizontal openings in the vertical members and a pin mover including a pin biaser urging the pin into a position locking the vertical members together, and a pin retractor for removing the pin from the locked position. The retractor is controlled manually or electrically by the user by means of a pull cord or switch in the leg brace. The pin and pin mover are concealed in the device and protected from damage. A pair of the devices provide improved stability and ease of use, are simple, durable and effective.

16 Claims, 5 Drawing Figures

STILT DEVICE

BACKGROUND OF THE INVENTION

1. Field of the Invention

The present invention generally relates to elevating means and more particularly to leg stilts of an improved type.

2. Prior Art

Painters, plasterers, electricians and the like, frequently require heavy ladders, platforms and like stable supports in order to reach elevated and/or inaccessible work areas with safety. However, much time and effort are usually expended in moving such supports into place and in shifting them around from location to location as the work progresses. It would be far more convenient and efficient if a stable, light weight, durable and portable means of elevating the worker could be used, particularly means which could be easily and safely adjusted in height and effortlessly shifted from location to location without discontinuing the work. Leg stilts have been used from time to time for such purposes, but are usually very unstable.

Conventional leg stilts usually do not include means for adjusting the height of the worker above the ground. Although certain types of stilts can be adjusted for height, the worker must get down from the stilts in order to adjust them, thus causing a great inconvenience. See for example, U.S. Pat. No. 3,365,195. A few types of stilts can be adjusted in height while being worn, but almost invariably are complicated in construction, expensive, heavy and clumsy. See for example, the stilts of U.S. Pat. No. 1,190,421 and U.S. Pat. No. 2,837,335. Although U.S. Pat. No. 238,042 discloses a relatively simple set of stilts capable of adjustment while being worn, such stilts are clearly unstable because the shoe stirrups shown extend laterally from the stilts. They could not be used by workman without risk. Moreover, the stilts have not support base at all. Also, the locking mechanism disclosed in that patent is primitive, uncertain and totally exposed to damage and malfunction. The stilts are clearly not safe and durable in use.

Therefore, a need still remains for a safe, durable, simple, efficient, stable and adjustable elevating device for use by workmen and the like.

SUMMARY OF THE INVENTION

The foregoing needs are satisfied by the improved leg stilt device of the present invention. The device is substantially as set forth in the Abstract above. Thus, the device is portable, light in weight, simple, durable and stable. It readily supports the leg of a workman in a safe solid position at any one of a number of heights and can be easily adjusted in height at will while the user is wearing the device. The large flat horizontal base assures the required stability. The concealed pin and pin-moving components are safe from damage and are easily manipulated from the top of the leg brace. The device can be made of light weight hollow tubular metal components and, if desired, can comprise an interconnected three- or four-legged construction to increase its rigidity and stability. Further features are set forth in the following description and accompanying drawings.

DETAILED DESCRIPTION OF THE PREFERRED EMBODIMENT

Figure 1:
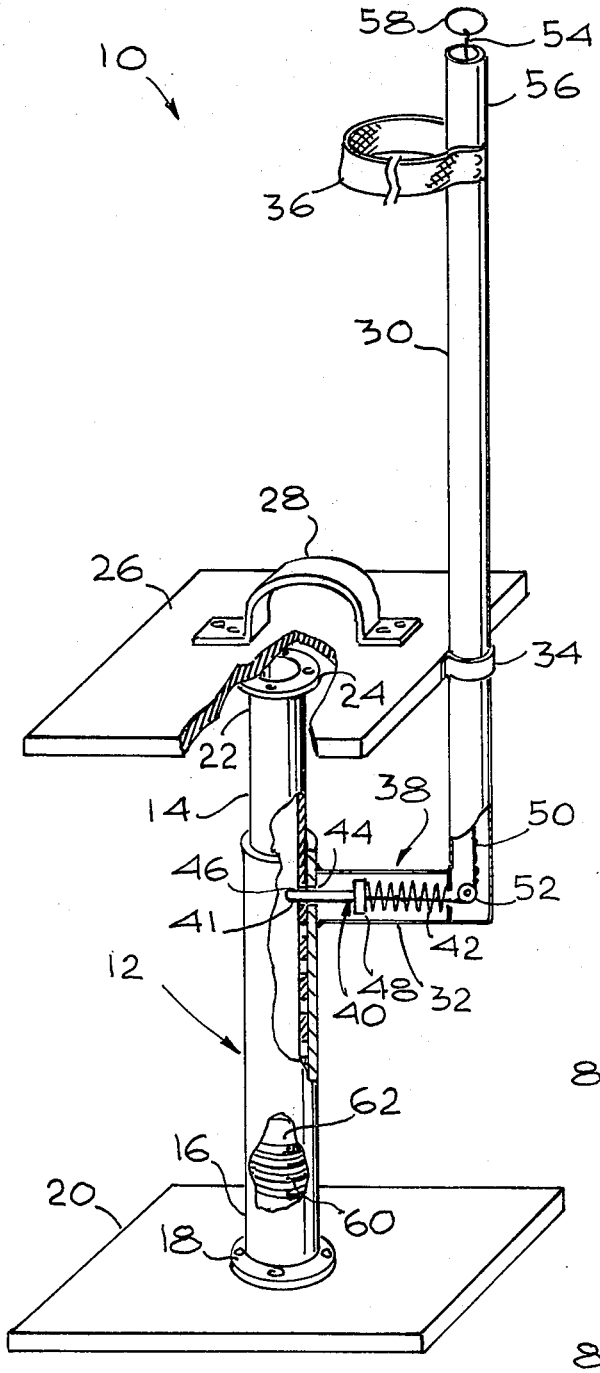
FIG. 1 is a schematic prospective view, partly broken away, of a first preferred embodiment of the improved leg stilt device of the present invention.

Now referring to FIG. 1 of the drawings, a first preferred embodiment of the improved leg stilt device of the present invention is schematically depicted therein. Thus, device 10 is shown which comprises a first hollow vertical tubular support member 12 and a second hollow vertical tubular support member 14 disposed in member 12 in telescoping relation therewith and extending upwardly therefrom. The lower end 16 of member 12 is secured by a collar to a large flat horizontally extending base plate 20 and the upper end 22 of member 14 is secured by a collar 24 to a large, flat, horizontally extending platform 26.

A shoe strap 28 is secured to the upper surface of platform 26. A hollow vertical tubular post forming a leg brace 30 is secured to device 10 by a horizontal arm 32 secured to member 12 and extending laterally thereof. Brace 30 extends above platform 26 through a side strap 34 connected to the side platform 26. An openable leg strap 36 is attached to brace 30 for releasably securing the leg of the stilt wearer when the wearer's shoe is in strap 28.

Members 12 and 14 are releasably secured together by means of a stilt height adjusting mechanism 38, comprising a horizontal pin 40 disposed in arm 32, with the shank 41 thereof biased by horizontal coil spring 42 through horizontal opening 44 in the sidewall of member 12 and one of a series of vertically spaced horizontal openings 46 in the sidewall of member 14. The selection of the particular opening 46 to align with opening 44 determines the height of member 14 above member 12 and thus the height of platform 26. Pin shank 41, while within aligned openings 44 and 46, as shown in FIG. 1, releasably holds the members 12 and 14 in the desired position.

The head 48 of pin 40 is connected to a chain 50 extending around roller pivot 52 in the area of juncture of arm 32 and brace 30. Chain 50 lies wholly within the protective enclosure of arm 32 and brace 30, except that the upper end 54 of chain 50 extends above the upper end 56 of brace 30 and terminates in a pull ring 58.

It will be understood that a pair of devices 10 are used, one per leg. The wearer of device 10 can readily adjust the height of platform 26 merely by pulling up on ring 58 to disengage pin shank 41 from openings 44 and 46. The wearer (while placing his or her weight on the opposite stilt device 10) can then lift up his leg, allowing a coil spring inside the lower end of member 14 and biasing up against a transverse butt plate 62 in member 14, to shove member 14 up relative to member 12, raising platform 26 to the desired height. Pull ring 58 is then released and shank 41 is biased by spring 42 through opening 44 and an opening 56 as it rises into alignment therewith. If the wearer wishes to lower platform 26, pull ring 58 is pulled up and platform is pressed down against the biasing action of spring 60 until the desired height is reached, whereupon pull ring 58 is released and shank 41 is forced through opening 44 and an opening 56 when it becomes aligned therewith during upward or downward movement of platform 26 and member 14. Full weight can then be transferred to the height adjusted stilt device 10 and the opposite stilt device 10 can be adjusted in height by the same procedure. As can be seen, device 10 is simple to use and adjust, and can be made inexpensively of light weight materials, such as aluminum, etc. The adjusting components thereof are concealed from damage and the device is very durable. Moreover, the device is very stable, offering a maximum of safety to the wearer.

Figure 2:
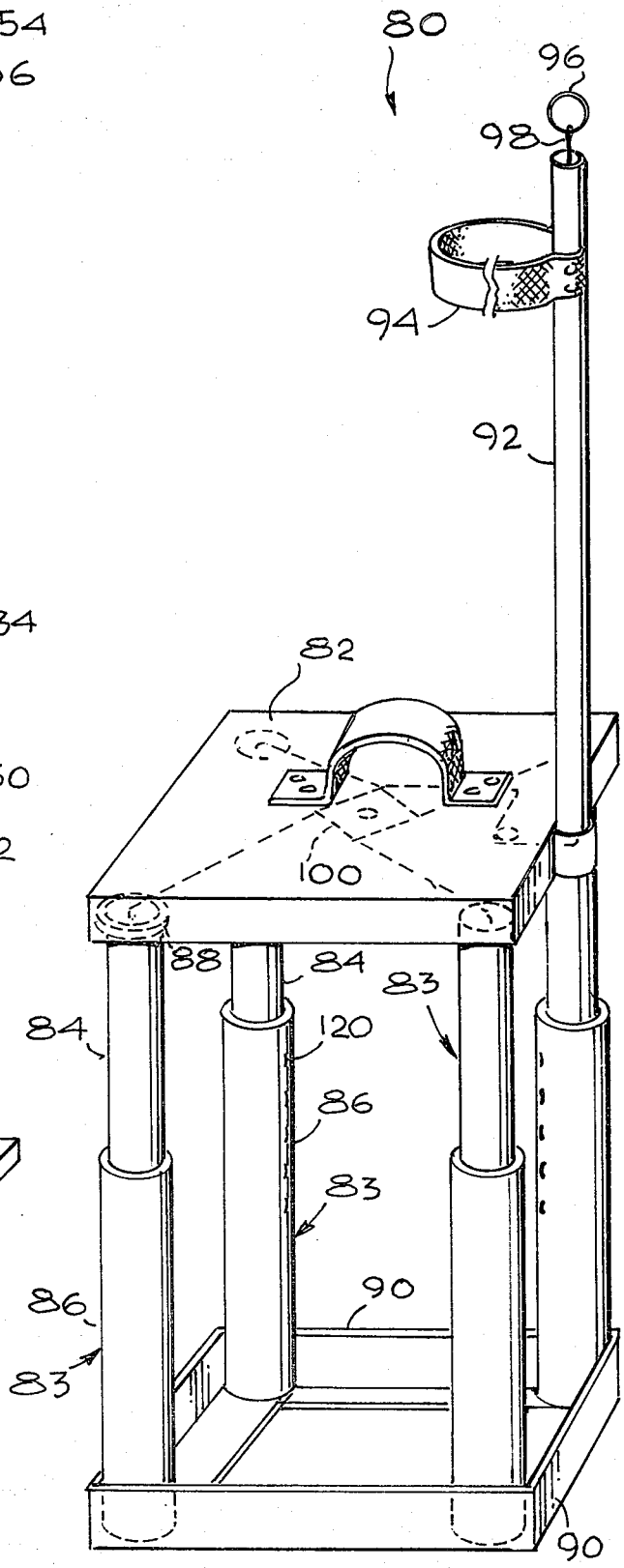
FIG. 2 is a schematic prospective view of a second preferred embodiment of the improved leg stilt device of the present invention.
Figure 4:
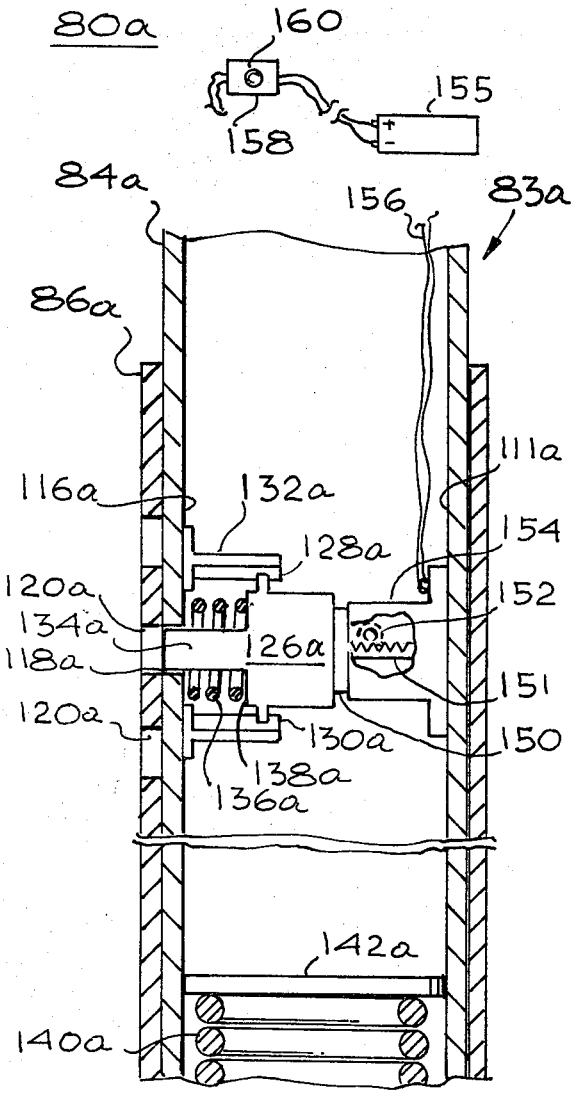
FIG. 4 is a schematic fragmentary sectional view of an alternative embodiment of the pin and pin-moving mechanisms in one of the telescoping legs of the device of FIG. 2.
Figure 5:
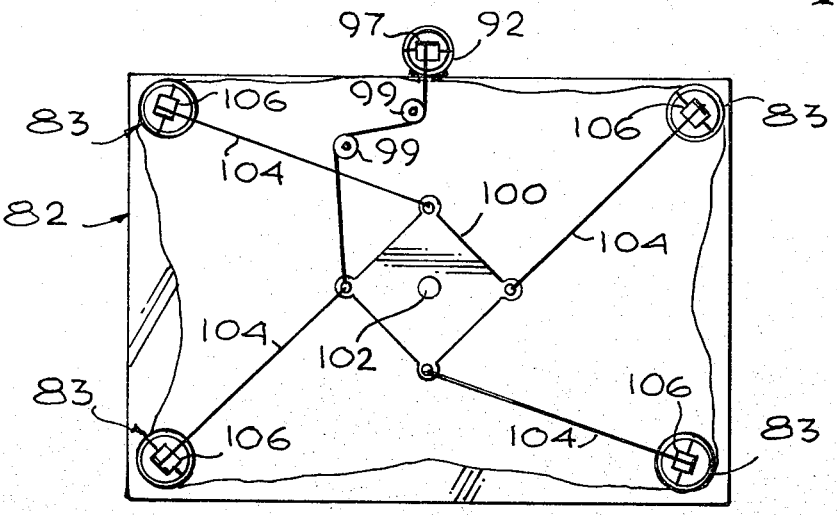
FIG. 5 is a schematic bottom plan view, partly broken away, of the platform of the device of FIG. 2, and the mechanism for simultaneously locking and unlocking the four legs of that device.

A second preferred embodiment of the improved stilt device of the present invention is schematically depicted in FIGS. 2, 4 and 5. Thus, device 80 is shown which comprises a flat horizontal, rectangular, hollow, openable platform 82 supported on four identical pairs of legs 83, each leg comprising an inner hollow cylindrical member 84 telescoping upwardly from an outer hollow cylindrical member 86. The upper end of each member 84 is secured by a collar 88 to a different corner of platform 82 and the lower end of each member 86 is interconnected with the other members 86 by horizontally extending plates 90 to form a broad flat sturdy base.

Figure 3:
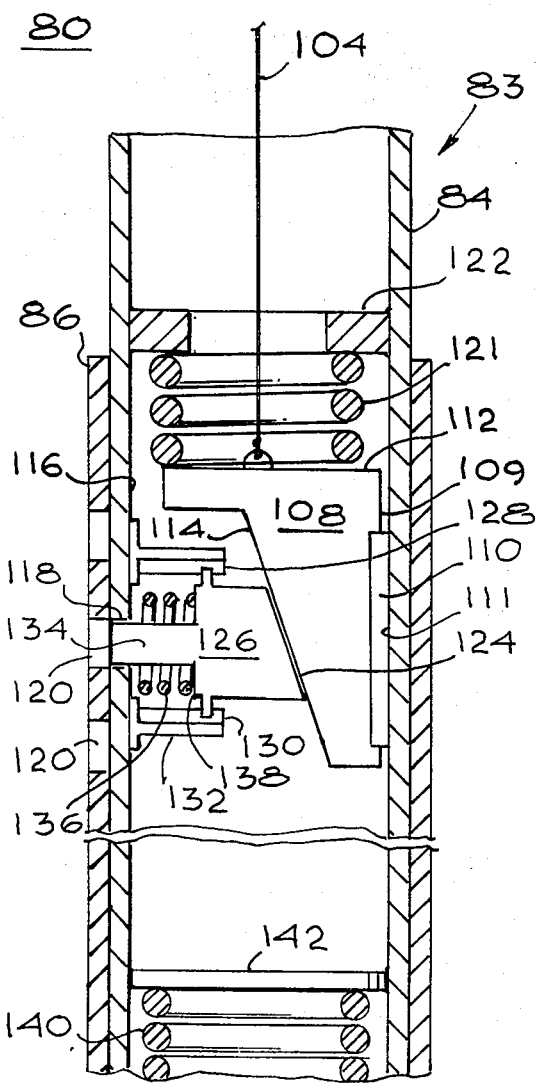
FIG. 3 is a schematic fragmentary sectional view of the pin and pin-moving mechanisms in one of the telescoping legs of the device of FIG. 2.

Secured to and rising above platform 82 is a hollow cylindrical leg post 92 bearing an openable leg strap 94. A pull ring 96 extends above post 92 and is secured to a cord 98 which passes down through post 92 and into platform 82, is turned around a pulley 97 and spaced rollers 99 and terminates at one corner of a square turn plate 100 (FIG. 5) concealed within the hollow interior of platform 82. Turn plate 100 is secured by a pin means 102, for rotation in the horizontal plane. separator cords 104 are secured to the four corners of plate 100, cords 104 passing over pulleys 106 and down into legs 83. As shown in FIG. 3, each cord 104 is connected to a vertically depending wedge 108 in member 84. Wedge 108 has a vertical surface 109 received in a guideway 110 secured to the inner surface of one side 111 of member 84, a flat top 112 and a downwardly sloped opposite surface 114 facing the opposite side 116 of member 84. The wedge is generally triangular shaped, with the apex thereof pointing down.

Side 116 defines an opening 118. Member 86 has a plurality of vertically spaced openings 120 on the side thereof adjoining side 116, opening 118 being alignable with each of openings 120. A spring 121 held between cross plate 122 and top 112 biases wedge 108 down against the sloped surface 124 of pin 126. Pin 126 is held in guideways 128 and 130 in bracket 132 secured to the inner surface of side 116 so that horizontal shank 134 of pin 126 is in turn biased to pass through opening 118 and aligning opening 120 (FIG. 3).

A spring 136 is positioned in bracket 132 against head 138 of pin 126 to cause pin shank 134 to retract form aligned opening 120 when ring 96 is pulled up to force wedge 108 into the retracted position shown in FIG. 3. In such position, each member 84 tends to move up relative to its associated member 86, due to the biasing action of the spring 140 positioned in each member 84 below a transverse butt plat 142 therein. If the stilt wearer shifts weight to the other stilt and pulls ring 96 up, platform 82 will tend to rise. As it rises to about the desired level, ring 96 can be allowed to drop and shank 134 will pass into whatever opening 120 becomes aligned with opening 118, causing leg 83 to releasably lock. The same action occurs in all legs 83 simultaneously, due to the rotation of turn plate 100, cords 104 being equidistant from the center thereof. If it is desired to lower platform 82, ring 96 is pulled up, platform 82 is pressed down and ring 96 is released, causing legs 83 to lock in place. Since the adjusting mechanism is fully concealed in platform 82, it is protected from damage. The four legs 83 provide a solid base for platform 82, and device 80 is very easily adjusted in height while being worn.

An alternative height adjusting mechanism for platform 82 is shown schematically in FIG. 4. Components similar to that of device 80 bear the same numerals, but are succeeded by the letter "a." Thus, device **80*a* is shown having members 86*a* and 84*a*. Within the latter is secured bracket 132*a* having a spring 136*a* secured to head 138*a* of pin 126*a* and wall 116*a*. Spring 136*a* draws head 138*a* toward openings 118*a* and 120*a*. Pin 126*a* is disposed in guideways 128*a* and 130*a* and shank 134*a* thereof is horizontally aligned to pass through opening 118*a* in wall 116*a* and one of aligned openings 120*a*. Head 138*a* is secured to a retractor 150 through a toothed shank 151, moveable horizontally by the toothed rotor 152 of a motor 154 secured to the inner surface of side 111*a* and powered by a battery 155 (attached to the platform or the like) through electrical conduits 156**.

A switch 158 is connected into the circuit between motor 150 and battery 155 and is closed by a push button 160, or the like, positioned in the leg brace and accessible to the stilt wearer. Closing the circuit by pushing button 160 causes retractor 150 to draw shank **134*a* out of opening 120*a*, to the position shown in FIG. 4, allowing spring 140*a* acting on plate 142*a* to force member 84*a* up in member 86*a*. Releasing button 160 allows spring 136*a* to draw shank 134*a* through aligned opening 120*a* to lock members 84*a* and 86*a* together. Device 80*a* otherwise operates exactly in the manner of device 80. Each leg 83*a* thereof is fitted with the desired height adjusting mechanism and operation of push button 160 simultaneously powers all motors 154 through battery 155**.

It will be understood that device **80*a* does not have members similar to pull ring 96, cord 98, rollers 99, plate 100, pin 102, cords 104, pulleys 106, wedge 108, guideway 110, spring 121 and plate 122. Therefore, it is simpler in construction than device 80**.

Various other modifications, changes, alterations and additions can be made in the improved stilt device of the present invention, its components of their parameters. For example, straps 28 and 36 can have Velcro fastening means secured to one end thereof to allow easy attachment and release of the foot and leg, respectively. Additionally, a small motor and associated electrical circuitry could be used to raise and lower the platform instead of the mechanical actuation means specifically disclosed in the application. Also, turn plate 100 could be located in the same plane as pin 126 with a direct connection of cord 104 through openings in the legs, to pin 126, which would be spring biased in a locking position, thereby obviating the need for pulleys 106. If desired, rubber, plastic or felt anti-marring means can be secured to the underside of plates 20 and 90 to prevent scratching of the surface upon which the stilts are placed.

What is claimed is:

1. An improved leg stilt device, said device comprising, in combination:

(a) a first hollow vertical support member;

(b) a second vertical support member disposed in telescoping relation inside said first member and extending vertically therefrom;

(c) a horizontal support platform connected to the upper end of said vertical member which extends up from the other of said vertical members and adapted to receive one leg of a user;

(d) a broad, flat, horizontal base connected to the lower end of the lowermost-extending one of said vertical members to impart stability to said device;

(e) a leg brace extending above and connected to said platform; and, (f) stilt height adjusting means releasably coupling said first and second vertical members together, said adjusting means comprising, in combination:

i. means for moving said platform vertically, ii. pin means releasably disposable through aligned horizontal openings in said vertical members, and iii. pin moving means, including pin retraction means disposed, in part, above said platform in said leg brace accessible to the user of said device and connected to said pin for moving said pin out of said openings and into the unlocked position, and pin biasing means urging said pin into said aligned openings to lock said vertical members together, said pins means and pin moving means being concealed within said device and protected against damage.

2. The improved stilt device of claim 1, wherein said leg brace includes a hollow vertical column and a leg strap connected to the outside thereof.

3. The improved stilt device of claim 1, wherein said means for moving said platform vertically includes a shoe strap.

4. The improved stilt device of claim 1, wherein said means for moving said platform vertically includes a spring biasing said vertical members into the extended telescope position.

5. The improved stilt device of claim 1, wherein said retraction means includes a flexible cord to the upper end of which is connected a pull ring.

6. The improved stilt device of claim 5, wherein said vertical members are tubular, wherein a plurality of spaced sets of said tubular members are connected to said platform and wherein said adjusting means are connected to each said set.

7. The improved stilt device of claim 6, wherein said adjusting means includes a turn ring member effecting simultaneous movement of said pin means associated with each said set of tubular vertical members.

8. The improved stilt device of claim 1, wherein said pin biasing means comprises a horizontally aligned spring coil pusher spring.

9. The improved stilt device of claim 1, wherein said pin means is horizontally disposed within the innermost of said two vertical members and bears a sloped inner surface, wherein said pin moving means is inside said inner vertical members and includes a vertical wedge disposed against said surface, a first spring biasing said pin towards said wedge and away from said openings and a second stronger spring biasing said wedge into said pin to urge said pin into said holes and lock said vertical members, and wherein said control means includes a cord connected within said innerpost vertical member to said wedge and extending to said brace for moving said wedge vertically away from said pin.

10. An improved leg stilt device, comprising:

(a) a platform;

(b) means secured to said platform adapted to work with a users foot to enable raising the platform;

(c) at least one vertically extendable support member secured to said platform;

(d) said support member having positive locking means adapted to lock said support member in a pre-selected position;

(e) actuator means connected to said locking means; and (f) one end of said actuator means being disposed above said platform to enable ready access thereto by a user.

11. The stilt device of claim 10 wherein a plurality of support members are provided.

12. The stilt device of claim 11 wherein each support member has a locking means associated therewith.

13. The stilt device of claim 12 wherein said actuator means is connected to each locking means.

14. The stilt device of claim 13 wherein said actuator means connected to each locking means act in unison.

15. The stilt device of claim 11, 12, 13 or 14 wherein said actuator means are mechanical.

16. The stilt device of claim 11, 12, 13 or 14 wherein said actuator means are electrical.

* * * * *